US007222765B2

(12) United States Patent
Robinson

(10) Patent No.: US 7,222,765 B2
(45) Date of Patent: May 29, 2007

(54) FUEL CELL ADAPTER FOR A LATCH

(75) Inventor: James W. Robinson, Mundelein, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 10/953,129

(22) Filed: Sep. 29, 2004

(65) Prior Publication Data

US 2005/0051593 A1 Mar. 10, 2005

Related U.S. Application Data

(63) Continuation of application No. 10/414,175, filed on Apr. 15, 2003, now Pat. No. 6,938,810.

(51) Int. Cl.
*B25C 1/08* (2006.01)
*B25C 1/18* (2006.01)
*B25B 1/16* (2006.01)

(52) U.S. Cl. ..... 227/10; 227/9; 227/130

(58) Field of Classification Search ..... 227/8, 227/9, 10, 130; 222/232, 3, 402.1, 401.3; 251/89.5; 137/318
See application file for complete search history.

(56) References Cited

U.S. PATENT DOCUMENTS 1,221,650 A 4/1917 Atkins et al.
1,654,550 A 1/1928 Muend
2,548,528 A * 4/1951 Hansen ..... 251/149.6
2,795,438 A * 6/1957 Oetiker ..... 285/33
3,035,617 A 5/1962 Breitenstein
3,177,018 A * 4/1965 Goodwin ..... 285/277
3,538,950 A * 11/1970 Porteners ..... 137/879
3,654,965 A 4/1972 Gramain
3,773,360 A * 11/1973 Timbers ..... 285/307
3,858,910 A 1/1975 Oetiker
3,907,012 A 9/1975 Burke
3,978,844 A 9/1976 Wilkens
4,065,029 A 12/1977 Chernock (Continued)

FOREIGN PATENT DOCUMENTS

DE 199 50 352 A1 3/2001

(Continued)

*Primary Examiner*—Louis K. Huynh
*Assistant Examiner*—Nathaniel Chukwurah
(74) *Attorney, Agent, or Firm*—Greer, Burns & Crain, Ltd.; Lisa M. Soltis; Mark W. Croll

(57) ABSTRACT

An insert seal for an adapter connectable to a fuel cell which is engageable upon a combustion tool fuel metering valve, the fuel cell having a stem and the metering valve having a nipple, includes a body defining a central passageway and having a first end sealable on the stem and a second end sealable on the nipple, a flange portion affixed to the second end, being in fluid communication with the passageway and having a larger diameter than the body. The fuel cell adapter is configured for connection to the fuel cell and is engageable upon the combustion tool fuel metering valve, has an adapter body with a base configured for engagement upon the fuel cell and a nozzle connected to the base, the adapter body defining a chamber configured for accommodating the stem and the nipple, the insert seal being accommodated in the chamber.

6 Claims, 7 Drawing Sheets

U.S. PATENT DOCUMENTS 4,094,384 A 6/1978 Heilmann
4,114,853 A * 9/1978 Medvick ..... 251/149.6
4,207,934 A * 6/1980 Scremin et al. ..... 141/383
4,218,888 A 8/1980 Jayne
4,331,277 A 5/1982 Green
4,449,737 A 5/1984 Specht
4,483,473 A 11/1984 Wagdy
4,483,474 A 11/1984 Nikolich
4,491,060 A * 1/1985 Boski ..... 92/128
4,522,162 A 6/1985 Nikolich
4,597,517 A 7/1986 Wagdy
4,712,379 A 12/1987 Adams et al.
4,717,060 A 1/1988 Cotta
4,739,915 A 4/1988 Cotta
4,751,452 A 6/1988 Kilmer et al.
4,875,709 A 10/1989 Caroll et al.
4,878,595 A 11/1989 Uhlig
4,902,043 A * 2/1990 Zillig et al. ..... 285/4
4,905,576 A 3/1990 Reynolds
4,911,194 A * 3/1990 Lechner ..... 137/75
4,971,224 A 11/1990 Scremin
4,995,643 A 2/1991 Rappart et al.
5,029,730 A 7/1991 Kostecki et al.
5,070,858 A 12/1991 Wang
5,163,598 A 11/1992 Peters et al.
5,213,247 A 5/1993 Gschwend et al.
5,263,439 A 11/1993 Doherty et al.
5,368,275 A 11/1994 Ketcham et al.
5,484,088 A 1/1996 Martin
5,567,074 A 10/1996 Dovak et al.
5,573,279 A * 11/1996 Rea et al. ..... 285/21.1
5,680,980 A 10/1997 Robinson
5,687,899 A 11/1997 Dohi et al.
5,782,508 A 7/1998 Bartholomew
5,800,940 A 9/1998 Bunyea et al.
5,911,443 A 6/1999 Le Quere
5,927,563 A 7/1999 Kellner
5,927,761 A 7/1999 Bartholomew
5,954,345 A 9/1999 Svoboda et al.
5,979,867 A 11/1999 Ortiz
5,988,039 A 11/1999 Denchfield et al.
6,016,945 A 1/2000 Phillips et al.
6,019,072 A 2/2000 Phillips et al.
6,032,833 A 3/2000 Olegnowicz
6,032,835 A 3/2000 Burt
6,032,836 A 3/2000 Hiscocks et al.
6,053,005 A 4/2000 Boitnott
6,058,960 A 5/2000 Kopp
6,085,945 A 7/2000 Fransen
6,109,165 A 8/2000 Velan et al.
6,139,359 A 10/2000 Fuhreck et al.
6,149,046 A 11/2000 Ho et al.
6,181,032 B1 1/2001 Marshall et al.
6,196,276 B1 3/2001 De Laforcade
6,217,085 B1 4/2001 Toulouse
6,233,966 B1 5/2001 Nayrac et al.
6,286,553 B1 9/2001 Morgan
6,302,297 B1 10/2001 Richardson et al.
6,321,742 B1 * 11/2001 Schmidt et al. ..... 126/38
6,371,338 B1 4/2002 Klein et al.
6,390,511 B1 * 5/2002 Kargula ..... 285/308
6,419,168 B1 7/2002 Thieleke et al.
6,463,894 B2 10/2002 Hasler et al.
6,253,860 B1 5/2003 Shkolnikov et al.
6,626,344 B2 * 9/2003 Shkolnikov et al. ..... 227/10
2002/0043547 A1 4/2002 Shkolnikov et al.
2002/0108992 A1 * 8/2002 Shkolnikov et al. ..... 227/10
2002/0117128 A1 8/2002 Shkolnikov et al.
2002/0162521 A1 11/2002 Shkolnikov et al.

FOREIGN PATENT DOCUMENTS

EP 0 936 031 8/1999
EP 1 093 887 A2 4/2001
EP 1 197 299 4/2002
FR 826699 6/1938
GB 1 311 322 3/1973

* cited by examiner

FUEL CELL ADAPTER FOR A LATCH

STATEMENT OF RELATED APPLICATION

This is a continuation of U.S. patent application Ser. No. 10/414,175 filed Apr. 15, 2003 now U.S. Pat. No. 6,938,810, entitled "Fuel Cell Adapter System For Combustion Tools."

BACKGROUND OF THE INVENTION

This invention relates to improvements in fuel cell adapter systems for use in combustion tools. As exemplified in Nikolich U.S. Pat. Nos. 4,403,722, 4,483,474, 4,522,162, and 5,115,944, all of which are incorporated by reference, it is known to use a dispenser to dispense a hydrocarbon fuel to a combustion gas-powered tool, such as, for example, a combustion gas-powered fastener-driving tool. Such fastener-driving tools and such fuel cells are available commercially from ITW-Paslode (a division of Illinois Tool Works, Inc.) of Vernon Hills, Ill., under its IMPULSE trademark. In particular, a suitable fuel cell is described in Nikolich U.S. Pat. No. 5,115,944, listed above.

A standard system for attaching a fuel cell to a combustion tool is known, i.e. placing the fuel cell into the combustion tool with a metering unit such as a valve, and having no adapter. This system has the advantage of being compact, however it does not protect the female metering unit inlet from dirt and other debris. Also, when not using an adapter, a protective cap or blister pack is needed for transporting the fuel cell.

There is another known fuel cell attachment system for combustion tools, where a sleeve-like seal support adapter attaches to a fuel cell and creates a seal for joining the fuel cell stem and a male joiner from the combustion tool. However, this adapter system does not protect the fuel cell from dirt and other debris. Another disadvantage is that the presence of this adapter alone is believed to diminish the life and capacity of the fuel cell.

One disadvantage of conventional combustion tool fuel cells as described above is that the conventional alignment structures employed for aligning the corresponding stems or passageways of the fuel cell and the tool fuel metering unit or valve do not provide consistent coaxial alignment of these passageways, which may lead to wasted fuel, shortened fuel cell life and less than optimal performance.

A related design problem of conventional combustion tool fuel cells is that proper alignment needs to be maintained between the fuel cell stem and the tool metering valve nipple, both during installation of the fuel cell into the tool and when exposed to the relatively rough, construction site or workshop working environment of such tools.

Maintaining a proper seal between the fuel cell stem and the tool metering valve nipple is also a problem, in that the seal needs to prevent the escape of fuel, while accommodating the sliding action of the fuel cell stem relative to the seal and the nipple as the fuel cell is inserted into, or withdrawn from the tool. Upon insertion into the tool, the fuel cell stem must be depressed into the fuel cell to permit the release of fuel. Further, if the fuel cell is removed from the tool before it is empty, the stem must be allowed to return to its closed or extended position to prevent fuel leakage.

Accordingly, there is a need for an improved fuel cell attachment system that protects the fuel cell from dirt and other debris while in use. In addition, there is a need for a fuel cell adapter system which maintains a positive, aligned engagement between the fuel cell stem and the tool fuel metering valve nipple, both during operation and insertion or removal of the fuel cell from the tool.

BRIEF SUMMARY OF THE INVENTION

The above-listed needs are met or exceeded by the present fuel cell adapter system for a combustion tool which features an adapter configured for secure attachment to the fuel cell. An adapter body portion of the adapter forms a chamber configured for receiving an insert seal. This seal is specially designed for maintaining a sealed relationship between the fuel cell and a fuel metering valve in the tool. Using the present insert seal, both a nipple of the fuel metering valve and a stem of the fuel cell are maintained in sealed fluid communication with each other upon insertion of the fuel cell into the tool. The seal accommodates movement of the fuel cell into the tool by being slidable in the chamber until the fuel cell is fully engaged. In addition, lobes on the front surface of the adapter are configured to align the mating fuel metering stem axially with the fuel cell housing.

An additional feature of the present invention is a set of breakable ribs which undergo shear failure upon attempted removal of the fuel cell adaptor from the fuel cell housing. An advantage of the present invention is that, if an attempt is made to remove the present adapter from the fuel cell, the connecting ribs of the fuel cell adapter undergo shear failure, causing the nose portion of the fuel cell adapter to become separated or otherwise structurally weakened from the base portion of the fuel cell adapter, which remains mechanically fastened to the fuel cell. Upon shear failure of the ribs, the fuel cell adapter cannot be reused on another fuel cell. This feature reduces the chance for the introduction of dirt, debris, or impurities that can interfere with the connection during reuse.

More specifically, the present invention provides an insert seal for an adapter connectable to a fuel cell which is engageable upon a combustion tool fuel metering valve, the fuel cell having a stem. The insert seal includes a body defining a central passageway and having a fuel cell end and a metering valve end, a flange portion affixed to the metering valve end, being in fluid communication with the passageway and having a diameter larger than the diameter of the body.

The fuel cell adapter is configured for connection to a fuel cell engageable upon the fuel metering valve of the combustion tool, the fuel cell having a stem and the metering valve having a nipple, the adapter includes an adapter body having a base configured for engagement upon the fuel cell and a nozzle connected to the base, the adapter body defining an axial chamber configured for accommodating the stem and the nipple, the present resilient insert seal being accommodated in the chamber. A combustion tool is also provided including a fuel metering valve and a fuel cell having an adapter with the present insert seal for providing sealing communication between the metering valve and a stem of the fuel cell.

DETAILED DESCRIPTION OF THE INVENTION

Figure 1:
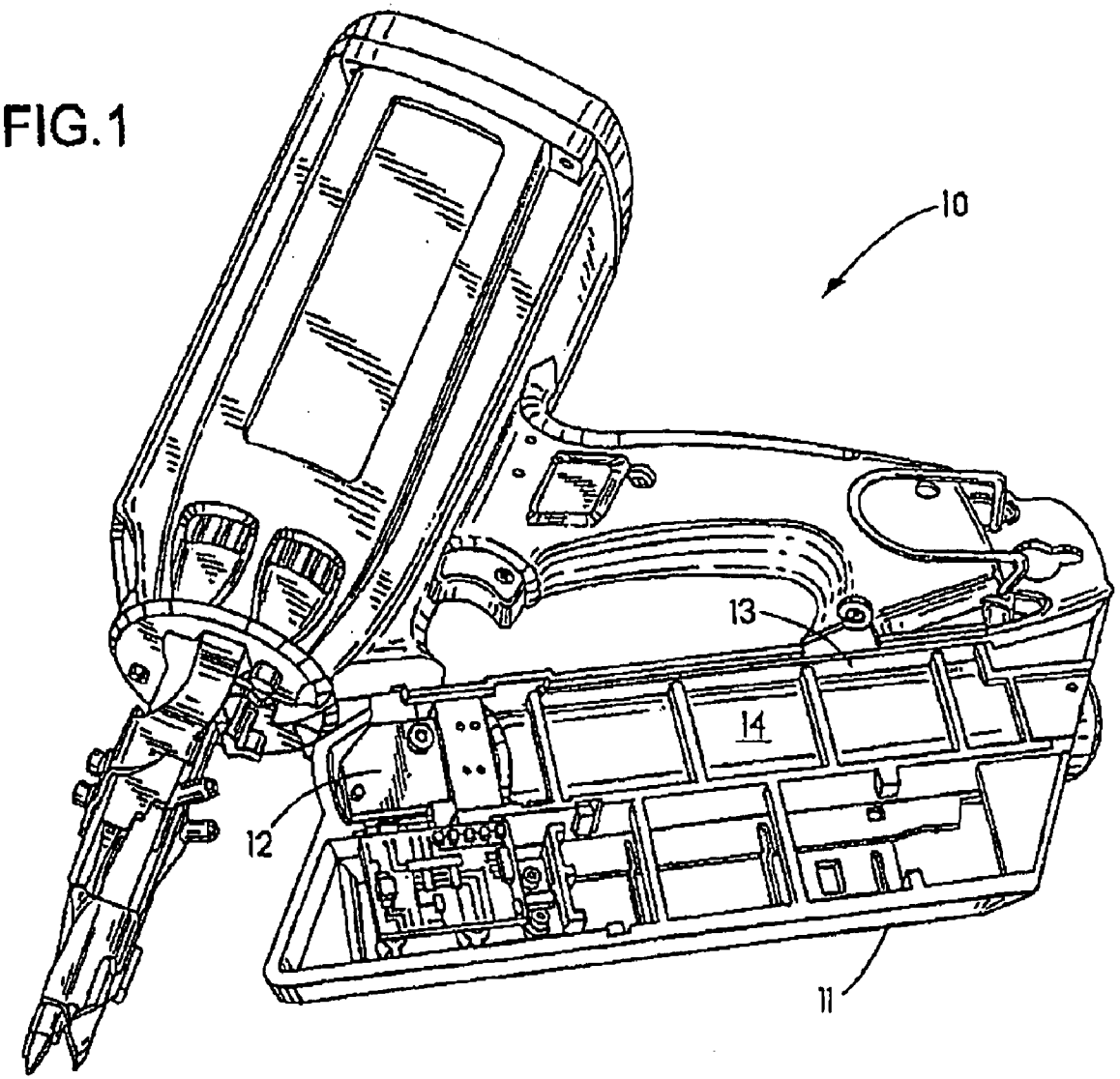
FIG. 1 is a perspective view of a combustion tool incorporating the present invention.

Referring now to FIG. 1, a combustion-powered tool of the type suitable for use with the present invention is generally designated 10. The tool 10 includes a housing 11 enclosing a fuel metering valve 12, and a fuel cell chamber 13 which releasably houses a fuel cell 14. The construction and operation of the tool 10 is described in detail in the patents incorporated by reference and referred to above. While a trim-type tool is depicted, it is contemplated that the present invention may be used with any type of combustion tool employing a fuel cell.

Figure 2:
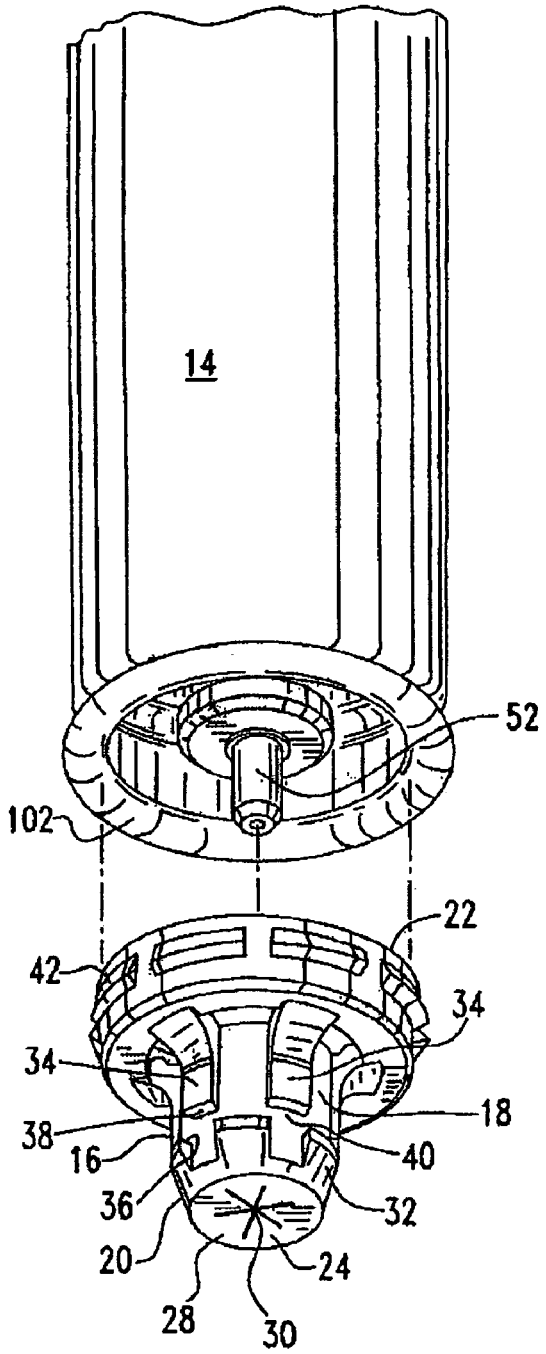
FIG. 2 is a fragmentary exploded perspective view of the present adapter and the fuel cell.
Figure 3:
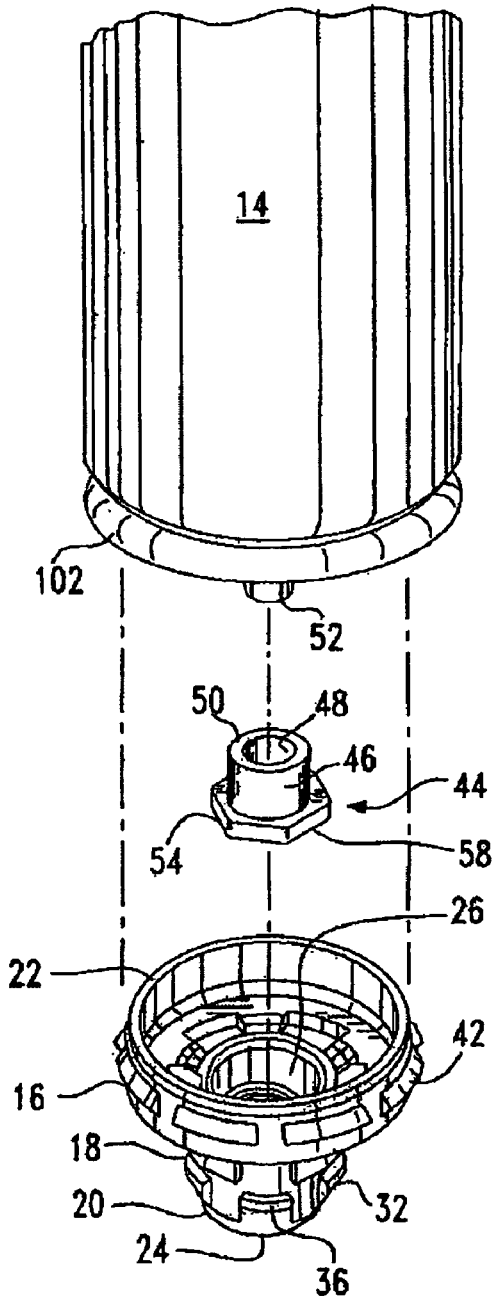
FIG. 3 is a fragmentary exploded perspective view of the present adapter, the insert seal and the fuel cell.

In FIGS. 2 and 3, a fuel cell adapter, generally designated 16, is configured for connection to the fuel cell 14, and facilitates engagement of the fuel cell in the fuel cell chamber 13. An adapter body 18 has a generally cylindrical nozzle 20 and a base 22 configured for engagement upon the fuel cell 14, and the nozzle is connected to the base. The nozzle 20 of the body 18 has a free end 24 and defines a chamber 26 which is preferably generally axial, with a frangible membrane 28 blocking the chamber 26. This frangible membrane 28 has a hole 30 that allows for air escape, and it is preferably disposed at or adjacent the free end 24 of the nozzle 20 for visually indicating tampering when ruptured. However, other locations along the chamber 26 are contemplated for the membrane 28. In a preferred embodiment, the diameter of the hole 30 measures about 0.010 inches, however the diameter may vary depending on the application.

On the adapter body 18, the nozzle 20 has a plurality of lugs 32, and a plurality of support ribs 34. The lugs 32 each preferably have a ramped configuration, extending in an inclined configuration from the free end 24 toward the base 22, and each preferably has a truncated lug end 36. The generally L-shaped support ribs 34 each preferably have a truncated rib end 38, and are configured for connecting the nozzle 20 to the base 22. In the preferred embodiment, individual lugs 32 and support ribs 34 are circumferentially spaced from each other, and the spacing of the lugs relative to the support ribs 34 is staggered, so that the lugs and support ribs are not in axial alignment with each other. Also, the ribs 34 hold the base 22 in a radially spaced relationship to the nozzle 20. It is contemplated that this configuration may change in view of tool, fuel cell and/or material performance requirements associated with particular applications.

In the preferred embodiment, the adapter 16 is provided with a gripping formation 40 which is configured for being engaged by a latch (not shown) disposed in the fuel cell chamber 13 of the housing 11. This gripping formation 40 may have a variety of shapes. In the embodiment depicted in FIGS. 2-5, corresponding truncated lug ends 36 and the rib ends 38 of the lugs 32 and the support ribs 34 define a groove 40 that is disposed on the nozzle 20. Although it is preferred that the adapter body 18 have a gripping formation 40 in the form of a groove as just described, it is also contemplated that the gripping formation is alternatively a rib or protrusion, generally radially extending from the adapter body 18. Such protrusions may form an annular rib or may also be individual, spaced, lugs or rib segments.

Also in a preferred embodiment, the lugs 32 are radially spaced relative to each other, and the support ribs are radially spaced relative to each other. The lugs 32 are also axially skewed, in other words, are not axially aligned relative to the opposing corresponding support ribs 34. Thus, as depicted in FIGS. 2 and 3, a staggered relationship is defined between the lugs 32 and the support ribs 34.

There is at least one barb 42 formed on the base 22 configured for frictionally engaging the fuel cell 14. In a preferred embodiment, there is a plurality of barbs 42 disposed in a radially extending fashion around the exterior of the base 22.

Referring now to FIGS. 3-8, the adapter body 18 houses an insert seal 44 which fits in the chamber 26. The insert seal 44 includes a body 46 defining an axial passageway 48 (best seen in FIGS. 4 and 5). In addition, the insert seal 44 has a first or fuel cell end 50 configured for receiving a fuel cell stem 52, and a second or valve nipple end 54 configured for sealingly engaging a fuel metering valve nipple 56 which projects from the valve 12. A flange portion 58 is affixed, preferably by integrally forming or molding, or attaching by known technologies the flange portion to the body 46 at the valve nipple end 54. The flange portion 58 thus defines the sealing location for the valve nipple 56 once the fuel cell 14 is operationally engaged on the tool 10.

Figure 8:
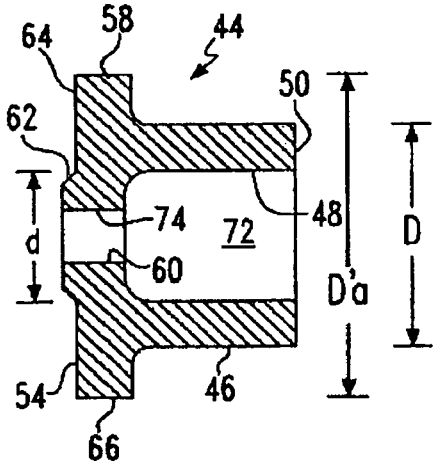
FIG. 8 is a section taken along the line 8-8 of FIG. 7 and in the direction generally indicated.

It will be seen that, in the preferred embodiment, the insert seal body 46 is preferably cylindrical (however other shapes are contemplated, such as polygonal), and has a diameter or height "D" (FIG. 8). It will be further seen that the flange portion 58 has a larger diameter "Da" (FIG. 8) than the diameter D of the body 46. To maintain fluid communication between the valve nipple 56 and the fuel cell stem 52, the flange portion 58 has an opening 60 in fluid communication with the passageway 48.

To obtain a positive sealing relationship with the valve nipple 56, the flange portion 58 has a boss 62 on an outer surface 64 of the flange portion. In the preferred embodiment, the boss is centrally located on the outer surface 64 and has a diameter "d" (FIG. 8) which is smaller than the diameter "D" of the seal body 46.

Figure 6:
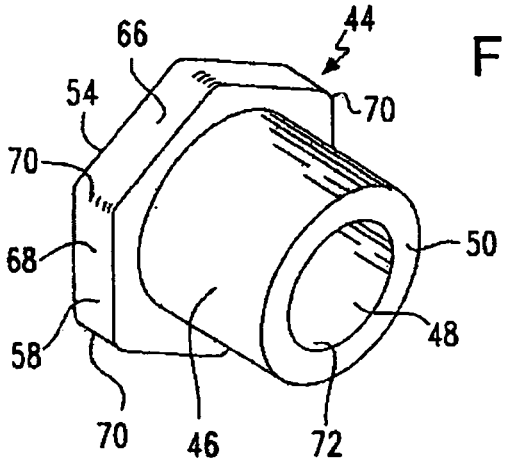
FIG. 6 is perspective view of an insert seal for use with the present adapter.
Figure 7:
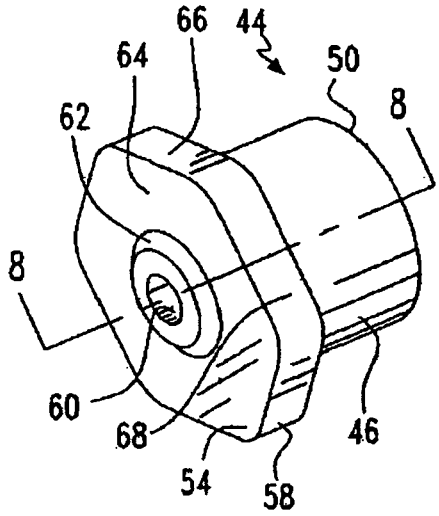
FIG. 7 is a reverse perspective view of the seal of FIG. 6.

Referring now to FIG. 6, it will be seen that the flange portion 58 has a periphery defining a surface 66 which is generally parallel to a longitudinal axis of the seal body 46. In the preferred embodiment, the peripheral surface 66 is faceted, being made of several facets 68 joined by radiused or rounded coners 70. However, sharp or non-radiused corners are also contemplated. The seal 44 is configured so that the corners 70 are the points of sliding contact with the chamber 26. It is preferred that the diameter "Da" of the flange portion 58 is dimensioned to maintain the relatively low resistance sliding relationship in the chamber 26, while still providing a centering function for preserving the alignment of the fuel cell stem 52 with the fuel valve nipple 56.

Improper alignment of these two tool components has been known to reduce fuel cell life and/or impair performance. While in the preferred embodiment, the surface 66 is hexagonal, it will be understood that a number of polygonal shapes are contemplated as being suitable, depending on the application.

At the opposite end from the flange portion 58, the insert seal body 46 defines a recess 72 configured for matingly accommodating the fuel cell stem 52. To provide for fluid communication between the fuel cell 14 and the metering valve 12, the recess 72 has an opening 74 (FIG. 8) which is in fluid communication with, and preferably coextensive with, the opening 60 in the flange portion 58, and being part of the passageway 48.

Figure 9:
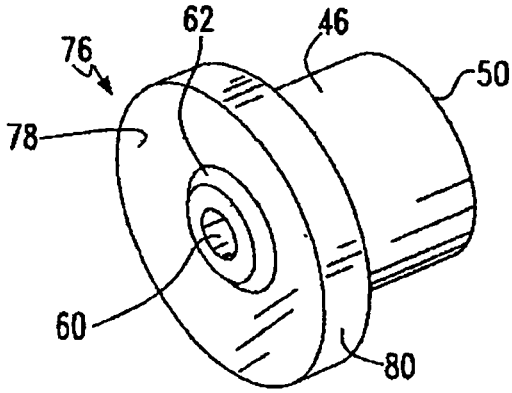
FIG. 9 is a perspective view of an alternate embodiment of the insert seal of FIG. 7.

Referring now to FIG. 9, while it is preferred that the peripheral surface 66 of the flange portion 58 is polygonaly faceted, it is also contemplated that the surface can be generally circular. In FIG. 9, an alternate insert seal is generally designated 76, and features which are shared with the seal 44 are designated with identical reference numbers. The main distinction between the seal 44 and the seal 76 is that the seal 76 is provided with a flange portion 78 having a peripheral edge surface 80 which is generally circular. It will be understood that the diameter "Da" of the flange portion 78 is dimensioned to promote the sliding/centering relationship discussed above in relation to the flange portion 58. Thus, among other things, the diameter "Da" may vary depending on the relative coefficient of friction between the flange portion 78 and the chamber, and the type of fuel cell valve and valve stem employed.

Regardless of the shape of the peripheral surface 66, 80, aside from providing a sliding contact surface with the chamber 26, the flange portions 58, 78 act to center the stem 52 in the adapter 16 and maintain proper alignment between the stem and the valve nipple 56. The insert seals 44 and 76 also support the engagement between the stem 52 and the nipple 56 during operation of the tool 10 to the extent that no other support is needed for the stem-nipple connection.

While both the seals 44 and 76 are slidable in the chamber 26, depending on the application, the materials used for the adapter 16 in general and the body 18 in particular, as well as materials used for the insert seal 44, 76, the relative sliding action between the insert seals and the chamber may vary. In the preferred embodiment, the insert seals 44 and 76 are relatively more resilient or rubber-like than the adapter 16. Specifically, the seals 44 and 76 are preferably made from epichlorohydrin rubber having an approximate hardness of 70 Durometer or equivalent material having the desired resilience, moldability and resistance to fuel permeation and swelling. Other materials having the desired characteristics listed above could be used for the insert seal 44, 76.

Another feature of the insert seals 44 and 76 is that a sealing relationship between the valve nipple 56 and the insert seals 44 and 76 is created by the mating engagement between the boss 62 and a counterbore 82 (FIGS. 4 and 5) formed at the end of the fuel metering valve nipple 56. The counterbore 82 defines a space configured for providing a relatively large surface area for contacting the boss 62. The boss 62 is configured to interlock with the counterbore 82. More specifically, the boss 62 is generally tapered or inclined from its base towards its outermost end (best seen in FIGS. 7 and 8). This shape, in conjunction with the resilient material used to form the insert seal 44, 76, results in a positive seal between the insert seal and the valve nipple 56. The counterbore portion of the preferably metallic valve nipple 56 forms a sharp edge which "bites" into the boss 62 upon operational engagement of the adapter 16 and its associated fuel cell 14 upon the tool 10.

To minimize fuel leakage, when the fuel cell 14 is withdrawn from the fuel cell chamber 13, as is well known in the art, the stem 52 is designed to snap to a fully extended position which closes an internal fuel cell valve (not shown) and prevents the escape of fuel. As such, the insert seal 44, 76, and specifically the recess 72, is configured to permit the stem 26 to slide to its original sealed position as soon as the fuel cell 14, with its attached adapter 16, is disengaged from the metering valve 12.

In the preferred embodiment, the adapter 16 is provided with other optional features which improve performance. While in use, the frangible membrane 28 has the advantage of protecting the fuel cell 14 from dirt and other debris. Adjacent the membrane 28, the adapter 16 is preferably provided with a plurality of optional lobes 90 (best seen in FIGS. 4 and 5) that facilitate operational engagement upon the valve nipple 56. In the preferred embodiment, there are three lobes 90, however it is contemplated that any number of lobes greater than two will be suitable. Each of the lobes 90 has an upper end 92, an outer wall 94, an inner wall 96 and a pair of sidewalls 98. To save material and prevent the clogging of the opposing surfaces of the adapter 16 and the valve nipple 56, the lobes 90 are circumferentially spaced about the free end 24. While not required, in the preferred embodiment, each of the lobes 90 is associated with a corresponding lug 32. Also, the inner walls 96 of the lobes 90 are chamfered in that they are inclined toward the membrane 28 to facilitate the appropriate coaxial engagement between the valve nipple 56 and the nozzle 20. In other words, the inner walls 96 perform a locating function for facilitating the engagement. Ultimately, the chamber 26 and the counterbore 82 of the valve nipple 56 are in coaxial alignment to permit the transfer of fuel from the fuel cell 14 to the metering valve 12.

Figure 5:
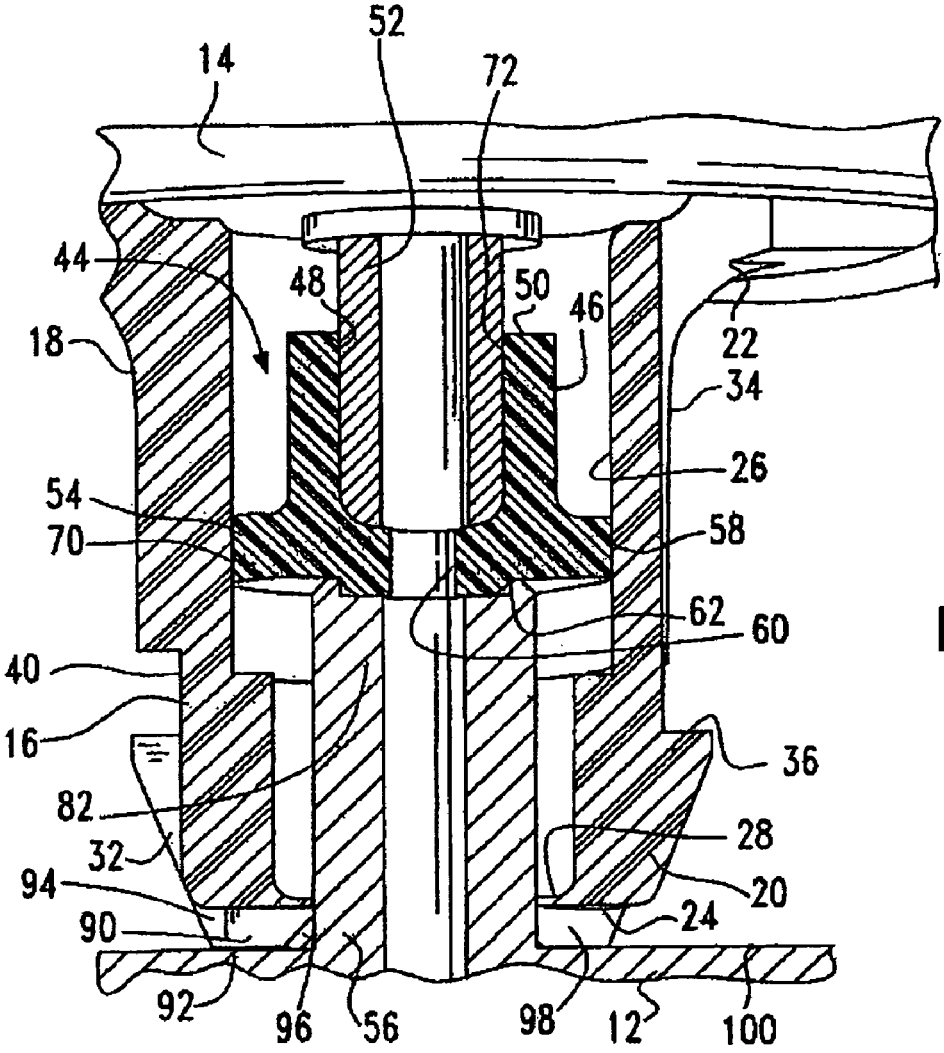
FIG. 5 is a fragmentary vertical section of the assembly of FIG. 4 showing full engagement of the fuel cell and adapter with the tool fuel metering valve.

Another feature of the lobes 90 is that they each preferably have the same length projecting axially from the nozzle 20, or the distance from the frangible membrane 28 to the upper end 92. Upon assembly, the upper ends 92 engage an opposing surface 100 of the metering valve 12 (FIG. 5). In this manner, appropriate alignment of the fuel cell 14 and the metering valve 12 is obtained, while creating a spacing between the two components which the user can easily clear of debris or dirt by blowing, vacuuming, etc. It is also preferred that the lobes 90 are each aligned or associated with a corresponding one of the lugs 32, and in the depicted embodiment, there is a lobe 90 associated with every other lug 32.

Another feature of the present adapter 16 is that the spaced supporting ribs 34 are the fastening point of the nozzle 20 to the base 22 and are configured to provide a break-away action if a user attempts to remove the adapter from the fuel cell 14. Upon shear failure of the ribs 34, the fuel cell adapter 16 cannot be reused on another fuel cell 14, eliminating the introduction of dirt, debris, or impurities that can interfere with the connection during reuse. This single use nature of the present adapter 16 also inhibits the use of refilled or generic fuel cells which may impede the optimal operation of the tool. It is contemplated that the shear failure of the support ribs 34 may be caused by varying the shape, size, thickness, and material composition of the ribs, or by adding scoring or other non-uniformities to the rib structure. The supporting rib structure 34 should include any other means known by one in the art to cause material failure at the rib location upon removal while maintaining sufficient strength to withstand the shock of combustion and the pressure of the gas propellant while in use.

A related design factor of the adapter is that the ribs 34 are configured so that the base 22 secures the adapter 16 to the fuel cell 14 more securely than the radially-spaced ribs 34 secure the nozzle to the base 22. Thus, upon an attempt to dislodge the adapter from the fuel cell 14, and a torquing force exerted on the nozzle 20, the nozzle breaks free of the base 22. One factor in securing the base 22 to the fuel cell 14 more rigidly than the nozzle 20 is held to the base is by configuring the periphery of the base to have at least one of the barbs or wedges 42 formed on the base and configured for frictionally engaging the fuel cell. In the preferred embodiment, the wedge 42 is disposed on the periphery of the exterior of the base 22 and is of slightly greater diameter than the inside diameter of the fuel cell 14. Upon compression and mechanical placement, the wedge 42 fits in tight configuration with the fuel cell 14 below a rolled seam 102 (FIG. 2) fixedly engaging the base to the fuel cell.

Referring now to FIGS. 2-5, to place the adapter 16 onto the fuel cell 14, the insert seal 44 is fitted onto the end of the fuel cell stem 52 so that the stem is matingly received in the recess 72. Next, the adapter 16 is placed over the fuel cell stem 52 and the insert seal 44 so that the insert seal is accommodated in the chamber 26. As described above, the dimensioning of the flange portion 58, 78 is such that the stem 52 is generally centered in the chamber 26 for facilitating alignment, and efficient fluid communication between the stem and the valve nipple 56. The installation and use of the insert seal 76 is identical to the insert seal 44 and as such is not described here. To securely attach the adapter 16 onto the fuel cell 14, the base 22 is mechanically compressed and pushed downward onto the rolled seam 102 (FIGS. 2 and 3) of the fuel cell, so that the wedges 42 on the base hook under and frictionally engage the rolled seam.

With the adapter 16 in place on the fuel cell 14 and before the system is placed in a combustion tool 10, the frangible membrane 28 will still be intact (unpierced) which gives the adapter the advantage of protecting the fuel cell during transportation. Because of this advantage, there is no need for a protective fuel cell cap. Another advantage is that the intact frangible membrane 28 gives visual identification that the fuel cell 14 is unused.

Figure 4:
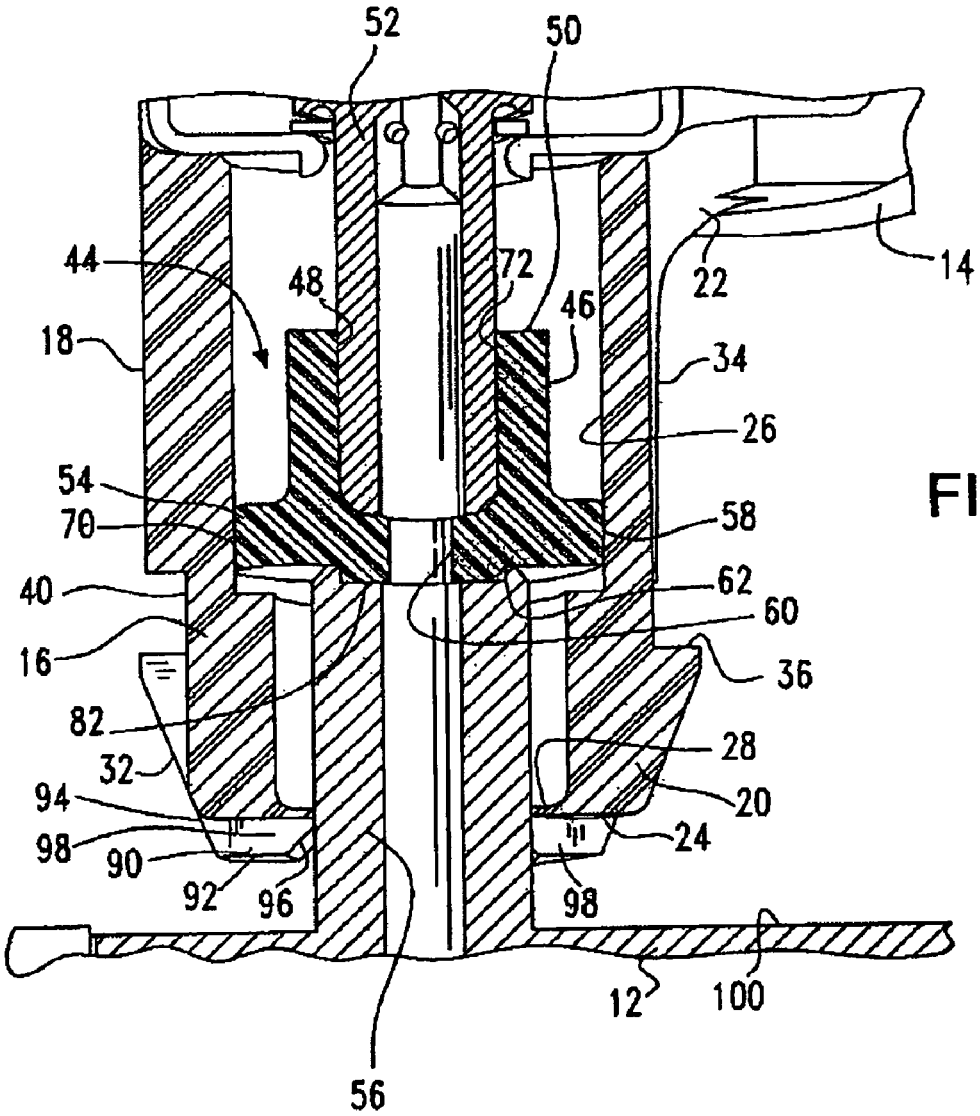
FIG. 4 is a fragmentary vertical section of the present fuel cell adapter system depicting the adapter and molded insert seal engaged with the fuel cell, prior to depression of the fuel cell stem.

Referring now to FIG. 4, the fuel cell 14 and the adapter 16 are shown engaged upon the valve nipple 56 in the position which occurs when the fuel cell is introduced into the fuel cell chamber 13 of the tool 10. The valve nipple 56 has pierced the frangible membrane 28 and the counterbore 82 has matingly engaged the boss 62 on the flange portion 58. However, at this point, the fuel cell 14 has not been fully pressed into engagement to the extent that fuel is flowing. This can be seen by the position of the fuel cell stem 52, which is still in the closed position. Note also that the insert seal 44 is positioned in the adapter chamber 26 closer to the nozzle end 24 than to the fuel cell 14.

Referring now to FIG. 5, it will be seen that the adapter 16 and the fuel cell 14 are now fully engaged upon the fuel metering valve 12, since the lobes 90 are in contact with the valve and the fuel cell stem 52 is now depressed. To accommodate this movement of components, the insert seal 44 has slidably moved within the chamber 26 towards the fuel cell 14 and away from the fuel metering valve 12. In this manner, a physically supportive and positive sealing connection between the fuel cell 14 and the valve nipple 56 is maintained. Further, the insert seal 44 is sufficiently slidable within the chamber 26, and the recess 72 is dimensioned so that upon withdrawal of the fuel cell 14 from the fuel cell chamber 13, the fuel cell stem 52 can readily return to the closed position without losing an unacceptable amount of fuel.

Figure 10:
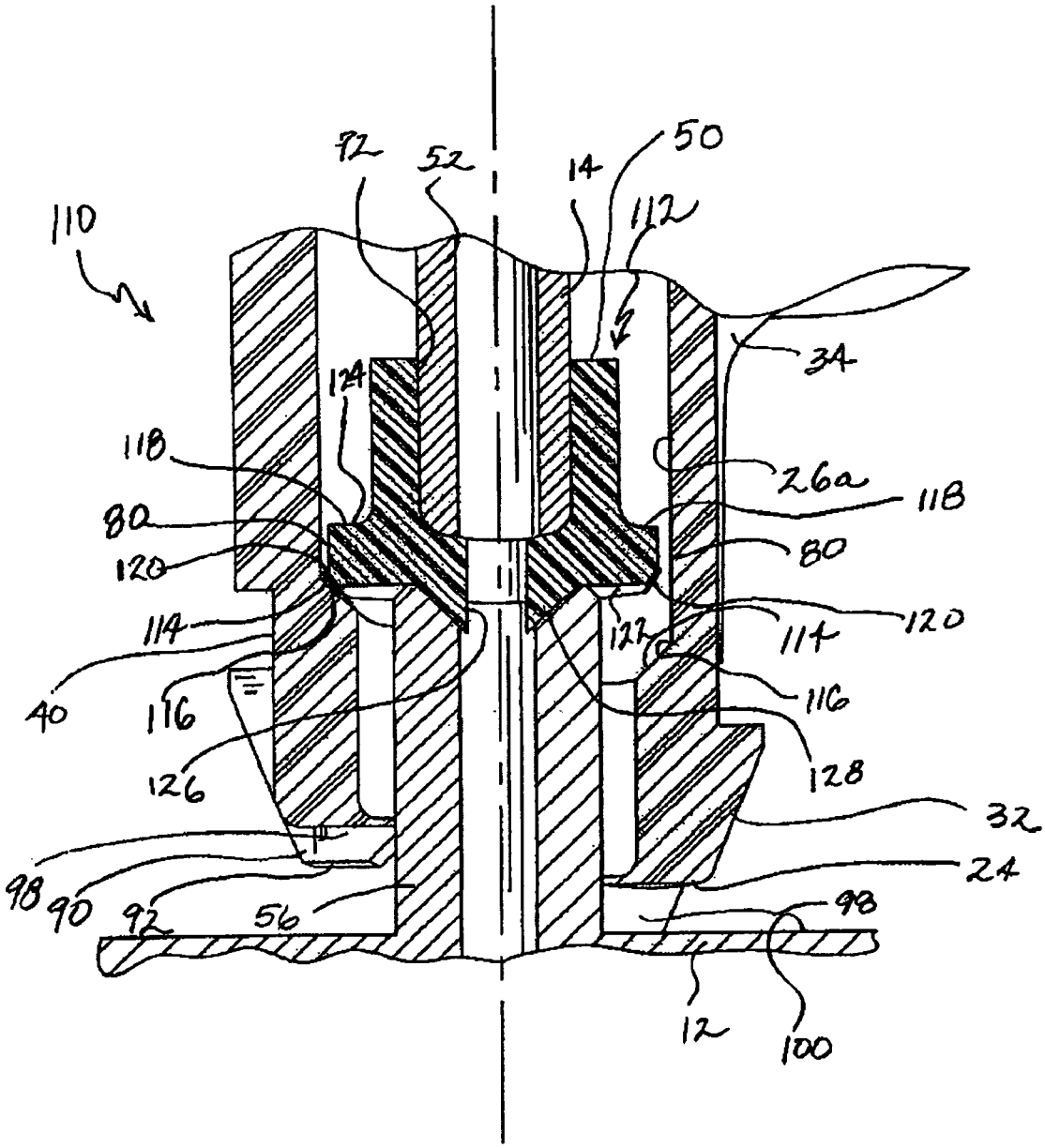
FIG. 10 is a composite section similar to FIGS. 4 and 5 of an alternate embodiment of the present insert seal and fuel cell adapter.

Referring now to FIG. 10, an alternate embodiment of the adapter 16 is shown and generally designated 110. Components of the adapter 110 which are shared with the adapter 16 are designated with identical reference numbers. The adapter 110 is provided with a modified insert seal 112, having shared features with the insert seal 44 designated with identical reference numbers. Also, FIG. 10 is provided in a split view format, combining the views of the positions shown in FIGS. 4 and 5.

One of the features of the adapter 110 which is a deviation from the adapter 16 is that a shoulder 114 at the fuel valve end of the chamber **26*a* has an angled or inclined configuration, compared to the right-angled shape of the adapter 16 of FIGS. 4 and 5. In the preferred embodiment, the angle of the shoulder 114 is 30°, however other angles are contemplated. This shoulder 114 defines a circular seat 116 which engages the peripheral surface 80 of a preferably circular flange portion 118 of the insert seal 112. This engagement facilitates the centering function of the flange portion 118 described above, since fuel cell stems 14** have been known to be off-center or skewed.

Also, since the internal fuel cell valve (not shown) has been known to leak, another function of the engagement of the flange portion 118 and the seat 114 is to prevent any fuel in the chamber 26 from escaping to ambient To facilitate this sealing function, the flange portion 118 is preferably provided with a beveled surface 120 on at least one face 122, 124 of the flange portion 118. The beveled surface 120 is generally complementary with the seat 114 to maximize the contact area between the two components and thus increase the sealed surface. However, a non-beveled or generally right-angled edge for the face and the peripheral surface is also contemplated, as shown in FIG. 9.

Another feature of the insert seal 112 is that a boss 126 extends axially from the flange portion 118 a greater distance than the boss 62. Further, the preferred construction of the boss 126 is generally conical or tapering from the face 122. This shape increases the sealing contact surface area between the boss 62 and a counterbore 128 of the valve nipple 56. Unlike the generally right-angled counterbore 82 of the embodiment of FIGS. 4 and 5, the counterbore 128 defines a generally conical cavity which is complementary with the boss 126, thus increasing the boss/counterbore surface contact area and similarly increasing the sealing relationship.

Figure 11:
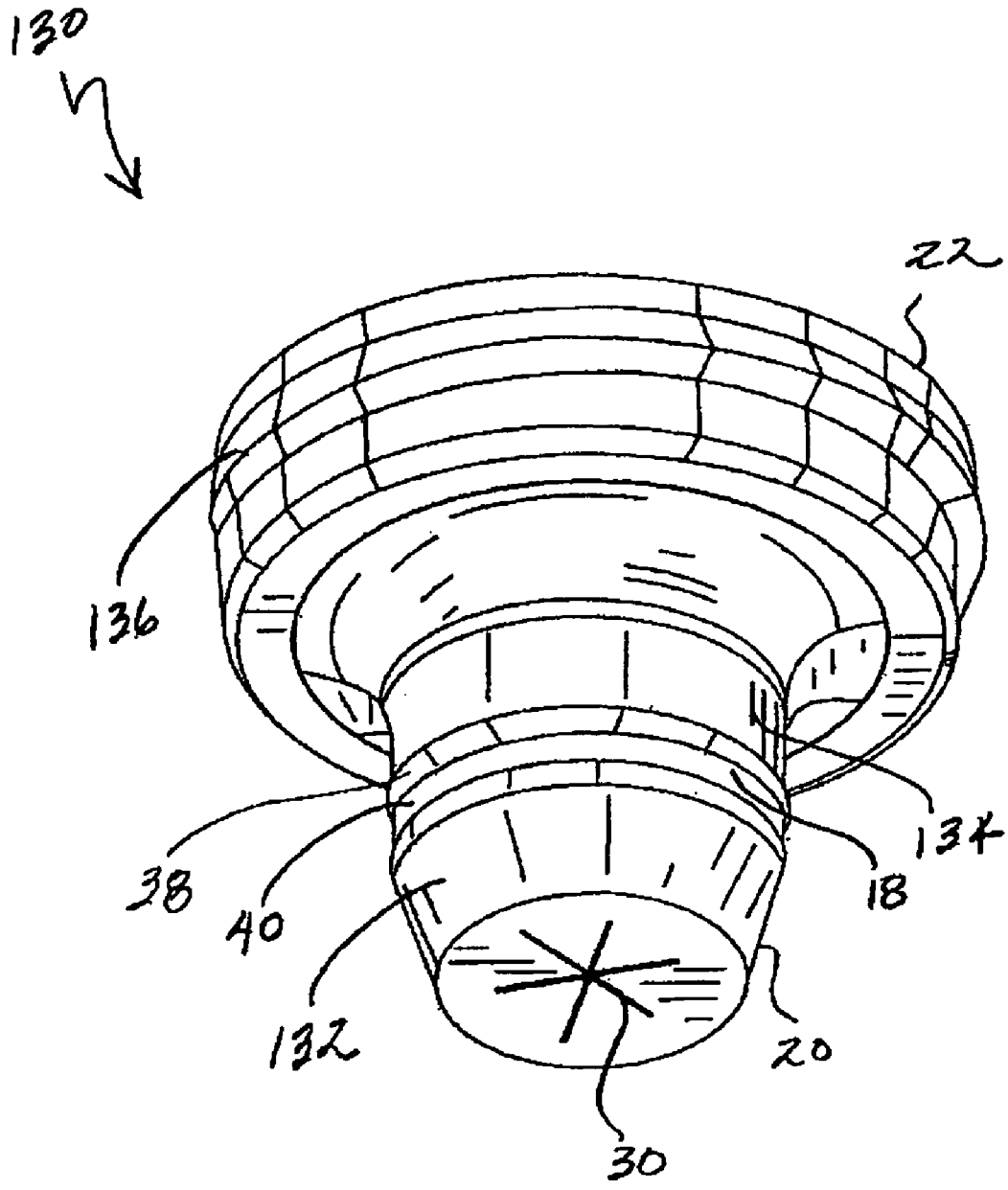
FIG. 11 is a perspective view of another alternate embodiment of the present fuel cell adapter.

Referring now to FIG. 11, another alternate embodiment of the adapter 16, 110 is generally designated 130. The adapter 130 shares many components and features with the adapters 16, 110 described previously, and its chamber (not shown) may take the form of either the chamber 26 or the chamber **26*a*. A main distinguishing feature of the adapter 130 is that instead of a plurality of lugs 32, there is a single annular angled lug 132. Similarly, instead of a plurality of support ribs 34, there is a single annular rib 134. It is also contemplated that when the single annular rib 134 is provided, there still may be spaced angled lugs 32**, and vice versa.

Furthermore, instead of a plurality of spaced barbs 42, there is a single annular barb 136 configured for achieving a tight friction fit with the rolled fuel cell seam 102. The friction fit is basically one-way, since once the adapter 130 is secured upon the rolled fuel cell seam 102, it cannot be removed without breaking the adapter. Once a user places a pliers or wrench on the adapter 130 and applies the amount of torque and gripping force necessary to remove the fit between the barb 136 and the rolled seam 102, a body portion 138 will become misshapen and misaligned, if not destroyed, to the point that it will be unusable.

While particular embodiments of the fuel cell adapter system has been shown and described, it will be appreciated by those skilled in the art that changes and modifications may be made thereto without departing from the invention in its broader aspects and as set forth in the following claims.

The invention claimed is:

1. A fuel cell adapter having an axis that aligns with a longitudinal axis of a fuel cell, configured for use with a combustion tool having a latching mechanism configured for engaging the adapter, the adapter comprising:

a substantially cylindrical nozzle;

a base configured for connection to a fuel cell and having a larger diameter than said nozzle;

one continuous rib on said nozzle circumscribing said nozzle, wherein said one continuous rib extends 360-degrees around the axis of the adapter, said rib having a cylindrical outer surface circumscribing the axis and extending 360-degrees around said nozzle;

one continuous lug on said nozzle circumscribing said nozzle, wherein said one continuous lug extends 360-degrees around the axis of the adapter, said lug having a generally smooth conical outer surface extending 360-degrees around the axis substantially along the axial length of said lug; and a gripping formation disposed on said nozzle between said lug and said rib, said gripping formation configured for being engaged by the latching mechanism which is external to said nozzle to be non-displaceable in the axial direction of said fuel cell with respect to the tool;

wherein said gripping formation is an annular groove circumscribing said nozzle and having two continuous side walls defining each side of said annular groove such that said groove has a constant width between said sidewalls over 360-degrees of said nozzle at each depth of said groove, said side walls being formed by proximal ends of said lug and said rib wherein said rib and said lug are integrally formed and are non-movable with respect to said gripping formation;

wherein said rib and said lug forming said annular groove have the same radial height as measured transversely from the axis to said cylindrical outer surface and to said conical outer surface, respectively;

wherein said one lug has a ramped configuration for opening the latch mechanism and inserting the adapter into the tool until the latch engages said gripping formation.

2. A fuel cell adapter configured for connection to a fuel cell configured for use with a combustion tool having a latching mechanism configured for engaging the adapter, the adapter comprising:

an adapter body having a nozzle and defining a passageway, said adapter body housing a molded insert seal in said passageway, wherein said molded insert defines an axial passageway and has a first end configured for receiving a stem and a second end provided with a pair of internal sealing rings located in said axial passageway;

a base configured for engagement upon the fuel cell;

one continuous rib on said nozzle circumscribing said nozzle, wherein said one continuous rib extends 360-degrees around the axis of the adapter, said rib having a generally smooth cylindrical outer surface circumscribing the axis and extending 360-degrees around said nozzle;

one continuous lug on said nozzle circumscribing said nozzle, wherein said one continuous lug extends 360-degrees around the axis of the adapter, said lug having a generally smooth conical outer surface extending 360-degrees around the axis substantially along the axial length of said lug; and a gripping formation on said nozzle defined by said at least one lug and said at least one rib, said gripping formation being a continuous annular groove circumscribing said nozzle and having two continuous side walls defining each side of said annular groove, said gripping formation being configured for engagement by the latching mechanism which is external to said nozzle and configured to be non-displaceable in the axial direction of the fuel cell with respect to the tool;

wherein said rib and said lug are integrally formed and are non-movable with respect to said gripping formation;

wherein said rib and said lug forming said annular groove have the same radial height as measured transversely from the axis to said cylindrical outer surface and to said conical outer surface, respectively.

3. A fuel cell adapter configured for connection to a fuel cell and having an axis that aligns with a longitudinal axis of the fuel cell, configured for use with a combustion tool having a latching mechanism configured for engaging the adapter, the adapter comprising:

an adapter body having a nozzle and defining a passageway;

a base configured for engagement upon the fuel cell;

at least one rib configured for connecting said nozzle to said base;

at least one lug on said nozzle;

a gripping formation on said nozzle defined by said at least one lug and said at least one rib, said gripping formation being a continuous annular groove circumscribing said nozzle and having two continuous side walls formed by said lug and said rib defining each side of said annular groove, wherein each of said side walls define a continuous plane of rotation about the axis of the adapter such that the axial distance between said lug and said rib is constant over 360-degrees of said nozzle at each depth of said groove, said gripping formation being configured for engagement by the latching mechanism which is external to said nozzle and configured to be non-displaceable in the axial direction of the fuel cell with respect to the tool; and upon engagement by the latch, said adapter being configured for providing fluid communication between the fuel cell and the tool;

wherein said rib and said lug are integrally formed and are non-movable with respect to said gripping formation;

wherein said rib and said lug forming said annular groove have the same radial height as measured transversely from the axis.

4. The fuel cell adapter of claim 3 wherein said base is snap-fit on said fuel cell.

5. The fuel cell adapter of claim 3 wherein said at least one lug has a ramped configuration for opening the latch mechanism and inserting the adapter into the tool until the latch mechanism engages said gripping formation.

6. The fuel cell adapter of claim 3 wherein said latch mechanism engages a substantial portion of the gripping formation.

* * * * *